United States Patent [19]
Clements
[11] 4,427,566
[45] Jan. 24, 1984

[54] WASHING COMPOSITIONS CONTAINING ORGANIC PERACID BLEACHES OR THEIR PRECURSORS AND IODIDE ION DONORS

[75] Inventor: Anthony H. Clements, Cefnoy bedd, Wales

[73] Assignee: Lever Brothers Company, New York, N.Y.

[21] Appl. No.: 345,908

[22] Filed: Feb. 4, 1982

[30] Foreign Application Priority Data

Feb. 16, 1981 [GB] United Kingdom ..... 8104826

[51] Int. Cl.[3] ..... C11D 7/54

[52] U.S. Cl. ..... 252/102; 252/94; 252/95; 252/96; 252/99; 252/8.6; 252/106; 252/186.2; 252/186.42; 8/137

[58] Field of Search ..... 252/102, 106, 94, 95, 252/96, 99, 8.6, 186.42, 187.2; 8/137

[56] References Cited

U.S. PATENT DOCUMENTS

| | | | |
|---|---|---|---|
| 2,931,777 | 4/1960 | Shelanski | 252/106 |
| 2,977,315 | 3/1961 | Sheik et al. | 252/106 |
| 3,189,518 | 6/1965 | Glasgon | 252/187.2 |
| 3,525,696 | 8/1970 | Schmidt et al. | 252/106 |
| 3,826,750 | 7/1974 | Wilson | 252/187.2 |
| 4,131,556 | 12/1978 | Klopotek et al. | 252/106 |
| 4,283,302 | 8/1981 | Foret et al. | 252/95 |
| 4,337,164 | 6/1982 | Clements | 252/96 |
| 4,338,210 | 7/1982 | Clements et al. | 252/96 |

FOREIGN PATENT DOCUMENTS

| | | |
|---|---|---|
| 24367 | 3/1981 | European Pat. Off. . |
| 24368 | 3/1981 | European Pat. Off. . |
| 1368400 | 9/1974 | United Kingdom . |

*Primary Examiner*—John E. Kittle
*Assistant Examiner*—Hoa Van Le
*Attorney, Agent, or Firm*—Amirali Y. Haidri; James J. Farrell

[57] ABSTRACT

Washing compositions especially designed for washing mixed colored fabrics including mixed loads of colored and white fabrics at lower temperatures are disclosed. The washing compositions comprise a bleach system useful for the reduction of dye-transfer in fabric washing at lower temperatures, said bleach system consisting essentially of (1) a peracid compound which may be an organic peracid, a peracid salt or an organic peracid precursor which generates peracids by hydrolysis or perhydrolysis, and (2) an organic or inorganic material which delivers iodide ions in aqueous media. Preferred material which delivers iodide ions in aqueous media is a water-soluble iodide salt, such as potassium or sodium iodide.

13 Claims, No Drawings

WASHING COMPOSITIONS CONTAINING ORGANIC PERACID BLEACHES OR THEIR PRECURSORS AND IODIDE ION DONORS

This invention relates to a washing composition, particularly for fabrics, which is effective at lower temperatures.

The washing composition of the invention is especially designed for washing mixed coloured fabrics, including mixed loads of coloured and white fabrics.

When washing mixed coloured fabrics and mixed loads of coloured and white fabrics, there is the risk of dye transfer through the wash liquor from one fabric to another, which may result in bleeding of colours, discolouration and/or staining of the fabrics.

The washing composition of the invention comprises a bleach system useful for the reduction of dye transfer in fabric washing at lower temperatures. By the term "lower temperatures", temperatures of up to 60° C., particularly up to 40° C., are meant here.

With the increasing trend of saving energy, housewives are becoming more and more energy-conscious and have gradually changed their washing habits towards lower wash temperatures. Moreover, there has been a tremendous increase in the domestic use of coloured textile material and therefore washing of coloured fabrics has become common habit to housewives as well as to laundries. These materials require treatment at lower wash temperatures in order to preserve their colours.

BACKGROUND ART

Inorganic persalts and other percompounds giving hydrogen peroxide in solution, such as sodium perborate and sodium percarbonate, are widely used as a bleaching agent in detergent compositions. Other known percompounds liberating hydrogen peroxide in solution are e.g. the alkali metal persilicates and perphosphates and urea peroxide.

These persalts and percompounds provide a satisfactory bleach when the detergent composition is used at high temperatures, e.g. 80°-100° C., but they become less effective on lowering the wash temperature and are even ineffective when used at lower wash temperatures.

It is known that organic peracids, e.g. peracetic acid, are active at lower temperatures and the use of peracids in detergent compositions, either as such or formed in situ, has been suggested to give the detergent composition satisfactory bleaching properties at lower temperatures, e.g. in the 60° C. wash cycle.

A considerable saving of energy would be obtained if washing habits could be further shifted towards cold and cool water washing, e.g. up to 40° C., also for whites.

However, such detergent compositions do not have the ability to sufficiently suppress dye transfer when used for washing mixed and/or coloured loads.

It is an object of the present invention to provide an improved bleach system useful for the reduction of dye transfer in fabric washing.

It is another object of the invention to provide a washing composition suitable for washing coloured fabrics and mixed white and coloured fabrics at lower temperatures without substantial risk of dye transfer from one fabric to another. British Patent Specification No. 1 368 400 describes the activation of organic peracids by means of rather complex aldehyde or ketone compounds as the bleach activator. The use of a chloride salt (in fabric washing) and of a chloride or bromide salt (in hard surface bleaching) is described in conjunction with said activated peracid system. In the co-pending applications GB No. 79,28589 and GB No. 79,28590, filed Aug. 16, 1979, or U.S. Pat. No. 4,338,210 which resulted from an application claiming priority under the aforementioned British Patent Application No. 7,928,589 and U.S. Pat. No. 4,337,164 which resulted from an application which was a continuation-in part of an earlier application which derived priority from British Patent Application No. 7,928,590, bleach compositions are described comprising a peracid or a peracid precursor and a water-soluble bromide.

DISCLOSURE OF THE INVENTION

It has now been found, surprisingly, that low concentration of iodide ions present during washing greatly increases the inhibition of dye-transfer or organic peracid bleach systems. In contrast therewith chloride ions are ineffective and bromide ions are only effective at much higher concentrations.

Effective concentrations of iodide ions are in the order of $10^{-4}$ moles/liter, and usually lie within a range of about $0.01\text{-}3.0\times10^{-4}$ moles/liter, the optimum level being about $0.5\times10^{-4}$ moles/liter.

A concentration of higher than $3.0\times10^{-4}$ moles/liter is useless since the increase of dye transfer inhibition will either become too insignificant or will be accompanied by too excessive staining of fabrics owing to iodine formation. A preferred range of iodide ion concentration is $0.1\text{-}1.5\times10^{-4}$ moles/liter.

The above figures correspond roughly to an iodide salt level of about 0.001-1.2% by weight, preferably 0.02-0.6% by weight, and an optimum level of about 0.1% by weight, in washing compositions used at a normal dosage of about 4 g/liter.

PH of the wash solution influences the dye transfer inhibition. In practice a pH between 6 and 11 will be suitable.

The washing composition of the invention therefore contains two essential ingredients: (1) a peracid compound which may be an organic peracid or a peracid salt, or an organic peracid precursor which is hydrolysed or perhydrolysed in aqueous media to form an organic peracid, and (2) an organic or inorganic material which delivers iodide ions in aqueous media.

The organic or inorganic material which delivers iodide ions in aqueous media is preferably a water-soluble iodide salt, such as potassium iodide or sodium iodide.

The organic peracids which can be used in the present invention are known in the art. They can be either aliphatic or aromatic and have the general formula:

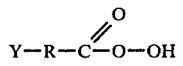

wherein R is an alkylene group containing from 1-16 carbon atoms or an arylene group containing from 6-8 carbon atoms and Y is hydrogen, halogen, alkyl, aryl or any group which provides an anionic moiety in aqueous solution, for example:

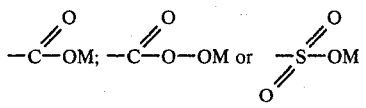

wherein M is hydrogen or a water-soluble salt-forming cation.

Examples of aliphatic peracids are peracetic acid, mono-perazelaic acid, diperazelaic acid and diperadipic acid.

Examples of aromatic peracids are monoperphthalic acid, perbenzoic acid, m-chloro-perbenzoic acid, diperisophthalic acid or mixtures thereof.

Examples of peracid salts as meant here include magnesium monoperphthalate and potassium monopersulphate.

In systems where the peracid is formed in situ from its precursor or precursors, the peracid can be formed from the combination of an organic precursor, so-called "persalt activator" and a persalt of the peroxyhydrate type, e.g. sodium perborate, by perhydrolysis, or from a precursor which generates peracid by hydrolysis. Hence various precursors will fall within the scope of use in the compositions of the invention. These include benzoyl peroxide and diphthaloyl peroxide, both of which are capable of generating peracids, i.e. perbenzoic acid and monoperoxyphthalic acid, respectively.

Precursors which generate peracid on perhydrolysis are also known in the art and include esters, such as those described in British Pat. Nos. 836,988 and 970,950, including glycerol penta-acetate and tetra-acetyl xylose; acyl amides, such as N,N,N,',N'-tetra-acetyl ethylene diamine (TAED), tetra-acetyl glycoluril, N,N'-diacetyl acetoxy methyl malonamide and others described in British Pat. Nos. 907,356; 855,735; 1,246,339 and U.S. Pat. No. 4,128,494; acyl azoles, such as those described in Canadian Pat. No. 844,481; acyl imides, such as those described in South African Pat. No. 68/6344; and triacyl cyanurates, such as described in U.S. Pat. No. 3,332,882.

The amount of peracid compound in the composition of the invention will be in the range generally of from 0.5 to 25% by weight, preferably from 1 to 15% by weight. These levels as defined for peracid compounds are applicable to organic peracids, peracid salts as well as precursors which generate peracids by hydrolysis or perhydrolysis.

In systems comprising an organic precursor and a persalt the organic precursor will advantageously be in at least the stoichiometric ratio to the persalt, though higher ratios of persalt to organic precursor can also be used, particularly if a persalt bleach scavenger, such as catalase, is present. Preferred persalts are sodium perborate and sodium percarbonate.

Precursors which generate peracids on perhydrolysis are therefore usable at levels of about 0.5–25% by weight, preferably 1–15% by weight, in conjunction with a persalt at levels of about 0.5–50% by weight, preferably 0.5–30% by weight of the composition.

Accordingly the invention relates to a washing composition comprising a peracid compound as defined hereinbefore, and an organic or inorganic material which delivers iodide ions in aqueous media.

Preferably the washing composition of the instant invention contains a surfactant. The surfactant can be anionic, nonionic, semi-polar, ampholytic or zwitterionic in nature, or can be mixtures thereof. These surfactants can be used at levels from about 5% to about 50% of the composition by weight, preferably at levels of about 10% to 35% by weight.

Typical anionic non-soap surfactants are the alkylbenzene sulphonates having from 8–16 carbon atoms in the alkyl group, e.g. sodium dodecyl benzene sulphonate; the aliphatic sulphonates, e.g. $C_8$–$C_{18}$ alkane sulphonates; the olefin sulphonates having from 10–20 carbon atoms, obtained by reacting an alpha-olefin with gaseous diluted sulphur trioxide and hydrolysing the resulting product; the alkyl sulphates, such as tallow alcohol sulphate; and further the sulphation products of ethoxylated and/or propoxylated fatty alcohols, alkyl phenols with 8–15 carbon atoms in the alkyl group, and fatty acid amides, having 1–8 moles of ethylene oxide or propylene oxide groups. Other anionic surfactants usable in the present invention are the alkali metal soaps (e.g. of $C_8$–$C_{22}$ fatty acids).

Typical nonionic surfactants are the condensation products of alkyl phenols having 5–15 carbon atoms in the alkyl group with ethylene oxide, e.g. the reaction product of nonyl phenol with 6–30 ethylene oxide units; the condensation products of higher fatty alcohols, such as tridecyl alcohol and secondary $C_{10}$–$C_{15}$ alcohols, with ethylene oxide, known under the trade-name of "Tergitols" ® supplied by Union Carbide; the condensation products of fatty acid amide with 8–15 ethylene oxide units and the condensation products of polypropylene glycol with ethylene oxide.

A typical listing of the classes and species of surfactants useful in this invention appear in the books "Surface Active Agents", Vol. I, by Schwarz & Perry (Interscience Publishers 1949) and "Surface Active Agents and Detergents", Vol. II, by Schwartz, Perry & Berch (Interscience 1958), the disclosures of which are incorporated herein by reference.

Generally, a washing composition of the invention will also include one or more detergency builders and alkaline materials. Usually the total amount of detergency builders in a detergent composition of the invention will be from about 5 to about 70 percent by weight of the detergent composition. Many detergency builders are known, and those skilled in the art of formulating fabric-washing detergent compositions will be familiar with these materials. Examples of known detergency builders are sodium triphosphate; sodium orthophosphate; sodium pyrophosphate; sodium trimetaphosphate; sodium ethane-1-hydroxy-1,1-diphosphonate; sodium carbonate; sodium silicate, sodium citrate; sodium oxydiacetate; sodium nitrilotriacetate; sodium ethylene diaminetetra-acetate; sodium salts of long-chain dicarboxylic acids, for instance straight chain ($C_{10}$ to $C_{20}$) succinic acids and malonic acids; sodium salts of alpha-sulphonated long-chain monocarboxylic acids; sodium salts of polycarboxylic acids; i.e. acids derived from the (co)polymerisation of unsaturated carboxylic acids and unsaturated carboxy acid anhydrides, such as maleic acid, acrylic acid, itaconic acid, methacrylic acid, crotonic acid and aconitic acid, and the anhydrides of these acids, and also from the copolymerisation of the above acids and anhydrides with minor amounts of other monomers, such as vinyl chloride, vinyl acetate, methyl methacrylate, methyl acrylate and styrene; and modified starches such as starches oxidized, for example using sodium hypochlorite, in which some anhydroglucose units have been opened to give dicarboxyl units. Another class of suitable builders is the insoluble alumino silicates as described in British Pat. Nos. 1,439,143; 1,470,250 and 1,529,454, e.g. zeolite A.

Further, a detergent composition of the invention may contain any of the conventional detergent composition ingredients in any of the amounts in which such conventional ingredients are usually employed therein. Examples of these additional ingredients are lather boosters, such as coconut mono-ethanolamide and palmkernel mono-ethanolamide; lather controllers; inorganic salts, such as sodium sulphate and magnesium sulphate; anti-redeposition agents, such as sodium carboxymethyl cellulose; and, usually present only in minor amounts, perfumes, colorants, fluorescers, corrosion inhibitors, germicides and enzymes.

The washing composition of the present invention can suitably be used in relatively short washes as well as in relatively longer soak-washings under room temperature conditions up to 60° C. for coloured fabrics, without the risk of substantial staining, bleeding of colours or discoloration of the fabrics.

It should be appreciated that the invention can also be formulated as a washing or bleach adjunct to improve the performance of existing detergent compositions, e.g. fine wash products. In that case the system will essentially consist of a peracid compound and a material which delivers iodide ions in aqueous media, with or without a persalt.

The washing compositions of the invention are preferably particulate, either as flowable powders or aggregates.

They can be prepared using any of the conventional manufacturing techniques commonly used or proposed for the preparation of particulate detergent compositions, such as dry mixing, or slurry making followed by spray-drying or spray-cooling and subsequent dry-dosing of sensitive ingredients, e.g. the solid organic peroxyacid compound, the inorganic peroxyhydrate salt and enzymes.

Other conventional techniques for taking precautions to improve storage stability or to minimize undue and undesirable interactions between the bleaching agents and other components of the detergent compositions, such as noodling, granulation, pelletizing and coating of any of the compound may be utilized as and when necessary.

The invention will now be illustrated by way of the following Examples in which all percentages are by weight, unless otherwise indicated:

EXAMPLES 1-5

Test fabrics were washed at 40° C. for 30 minutes (Tergotometer; 100 rpm) using a standard detergent base powder* including a peracid (or peracid precursors) and potassium iodide. In each wash the standard detergent base powder was used in a concentration of 4 g/liter in 18° hard water with a liquor to cloth ratio of 50:1.

| *Spray-dried standard detergent base powder composition | (parts by weight) |
|---|---|
| Sodium $C_{12}$ alkylbenzene sulphonate | 14.0 |
| Coconut ethanolamide | 1.8 |
| Sodium triphosphate | 19.0 |
| Alkaline sodium silicate (1:2) | 9.8 |
| Sodium carboxymethylcellulose | 0.3 |
| Sodium ethylene diamine tetraacetate | 0.1 |
| Dimorpholino fluorescer | 0.3 |

-continued

| *Spray-dried standard detergent base powder composition | (parts by weight) |
|---|---|
| Sodium sulphate | 35.0 |
| Water + miscellaneous | 5.0 |

One 17.5 cm×17.5 cm square of nylon test cloth dyed with CI disperse Blue 16 dye (Cibacit Sapphire 4G ex Ciba Geigy) was used in each wash. The fabrics for dye pick-up were white bulked nylon 66 (non-fluorescent), One 12 cm×12 cm square of this dye transfer monitor cloth was put in the wash together with the dyed test cloth.

Each set of cloths was rinsed separately after each wash with three 600 ml portions of cold 18° hard water.

The reflectance of the cloths was measured at the maximum absorbance wavelength of the dye using a Beckman DB-GB grating spectrophotometer fitted with a diffuse reflectance attachment. Barium sulphate was used to standardise the instrument and as a reference when measuring the cloths.

Five series of washings were carried out using the following bleach systems whilst varying the KI concentration:

(1) N,N,N',N'-tetra-acetyl ethylene diamine (0.12 g/l=approx. 2.8% on product) sodium perborate tetrahydrate (0.081 g/l=approx. 1.9% on product)
(2) Glucose penta-acetate (0..205 g/l=approx. 4.8% on product) sodium perborate tetrahydrate (0.081 g/l=approx. 1.9% on product)
(3) Tetra-acetyl xylose (0.167 g/l=approx. 3.9% on product) sodium perborate tetrahydrate (0.081 g/l=approx. 1.9% on product)
(4) Potassium monopersulphate ($4.6\times10^{-4}$ moles/liter)
(5) Diperisophthalic acid ($2.3\times10^{-4}$ moles/liter)

The results are tabulated below:

TABLE A (Experiment 1)

| KI Moles/liter $\times 10^{-4}$ | Final reflectance of nylon dye transfer monitor (R 675) | KBr Moles/liter $\times 10^{-4}$ | Final reflectance of nylon dye transfer monitor (R 675) |
|---|---|---|---|
| 0 | 61.0 | 0 | 61.0 |
| 0.05 | 75.0 | 20.0 | 67.2 |
| 0.1 | 78.5 | 40.0 | 74.4 |
| 0.6 | 80.8 | 84.0 | 75.0 |
| 1.1 | 78.5 | 170.0 | 82.0 |
| 1.5 | 74.0 | | |
| 2.0 | 70.5 | | |
| 3.0 | 66.0 | | |
| 5.4 | 61.0 | | |
| 10.0 | 61.0 | | |

TABLE B (Experiment 2)

| KI Moles/liter $\times 10^{-4}$ | R 675 |
|---|---|
| 0 | 66.0 |
| 0.0135 | 71.4 |
| 0.026 | 79.2 |
| 0.053 | 82.4 |
| 0.1 | 83.0 |
| 1.0 | 73.5 |
| 5.0 | 67.0 |

TABLE C (Experiment 3)

| KI Moles/liter $\times 10^{-4}$ | R 675 |
|---|---|
| 0 | 67.0 |
| 0.0135 | 71.0 |
| 0.026 | 78.0 |
| 0.053 | 81.2 |
| 0.1 | 81.8 |
| 1.0 | 76.2 |
| 3.0 | 69.4 |
| 4.0 | 67.0 |
| 5.0 | 65.0 |

TABLE D (Experiment 4)

| KI Moles/liter $\times 10^{-4}$ | R 675 |
|---|---|
| 0 | 70.6 |
| 0.2 | 82.4 |
| 0.5 | 83.5 |
| 1.0 | 83.0 |
| 1.5 | 75.0 |
| 2.5 | 68.0 |
| 3.0 | 65.0 |
| 5.0 | 64.0 |

TABLE E (Experiment 5)

| KI Moles/liter $\times 10^{-4}$ | R 675 |
|---|---|
| 0 | 69.4 |
| 0.25 | 76.6 |
| 0.5 | 79.8 |
| 0.95 | 82.4 |
| 2.0 | 83.5 |
| 3.0 | 84.2 |
| 5.0 | 84.4 |

The effectiveness of potassium iodide at low concentrations to reduce dye-transfer is clearly shown. In contrast therewith the effect of potassium bromide is only significant at much higher concentrations.

EXAMPLE 6

Another series of dye-transfer washing experiments was carried out with cotton test cloths, using: N,N,N',N'-tetra-acetyl ethylene diamine ($5.3\times10^{-4}$ moles/liter=0.12 g/l=2.8% on product), and sodium perborate tetrahydrate ($5.3\times10^{-4}$ moles/liter=0.081 g/l=1.9% on product) as the bleach system, whilst varying the KI concentration.

Washing conditions were the same as those described in Examples 1–5, except that (1) one 17 cm×8.4 cm piece of cotton test cloth dyed with 1% CI Direct Blue 1 dye was used in each wash, and (2) the fabric for dye pick-up was white cotton calico (non-fluorescent).

The results are tabulated below.

TABLE F (Experiment 6)

| Iodide concentration g/l | (% on product) | P/I Theoretical max peracid:iodide molar equivalent | Final reflectance of cotton dye transfer monitor (R 590) |
|---|---|---|---|
| 0 | — | — | 54.9 |
| 0.0018 | (0.043%) | 48:1 | 68.5 |
| 0.0053 | (0.13%) | 16:1 | 68.5 |
| 0.0088 | (0.21%) | 10:1 | 72.6 |
| 0.0130 | (0.31%) | 7:1 | 71.9 |
| 0.0174 | (0.41%) | 5:1 | 70.7 |
| 0.0873 | (2.0%) | 1:1 | 57.1 |
| 0.1746 | (4.0%) | 0.5:1 | 58.5 |

The above table F clearly shows effective dye-transfer inhibition using the bleach system of the invention.

EXAMPLE 7

This example shows the effect of perborate concentration and perborate/TAED ratio on dye-transfer inhibition using the system of the invention.

Test fabrics (nylon test cloths dyed with Disperse Blue 16 and white bulked nylon 66 for dye pick-up) were washed at 40° C. for 30 minutes using standard detergent base powder under the same washing conditions as described in Example 1–5.

The bleach system used consisted of potassium iodide (0.0088 g/l=approx. 0.2% on product), TAED (0.12 g/l=approx. 3% on product) and sodium perborate tetrahydrate at varying amounts.

The results are shown in the table below:

TABLE G

| Perborate g/l | (% on product) | P/I Theoretical max peracid:iodide molar equivalent | Final reflectance of nylon dye transfer monitor R 675 −Catalase | +Catalase |
|---|---|---|---|---|
| 0 | 0 | — | 63.3 | 62.8 |
| 0.022 | 0.5 | 3:1 | 81.1 | 77.7 |
| 0.066 | 1.6 | 8:1 | 82.4 | 83.7 |
| 0.11 | 2.6 | 13:1 | 81.0 | 83.8 |
| 0.155 | 3.6 | 20:1 | 81.1 | 83.7 |
| 0.2 | 4.6 | 20:1 | 79.5 | 83.1 |
| 0.24 | 5.5 | 20:1 | 62.6 | 82.3 |
| 0.36 | 8.0 | 20:1 | 62.7 | 82.3 |
| 0.48 | 10.0 | 20:1 | 62.6 | 80.2 |
| 0.60 | 13.0 | 20:1 | 63.0 | 81.2 |
| 0.72 | 15.0 | 20:1 | 63.5 | 79.7 |

The beneficial effect of Catalase at higher perborate to TAED ratios is clearly shown.

I claim:

1. A composition for washing fabrics in aqueous media, comprising:

(a) about 0.5 to about 25% by weight of a peracid compound selected from the group consisting of organic peracids, peracid salts, peracid precursors from which peracids are liberated by hydrolysis or perhydrolysis and mixtures thereof; and (b) about 0.002 to about 1.2% by weight of an iodide ion donor which is effective in aqueous media.

2. A washing composition according to claim 1, wherein the iodide ion donor which is effective in aqueous media is a water-soluble iodide salt.

3. A washing composition according to claim 2, wherein the water-soluble iodide salt is selected from the group consisting of potassium iodide, sodium iodide and mixtures thereof.

4. The washing composition of claim 1, comprising:

(a) a mixture of one or more of said peracid salts with one or more of said peracid precursors wherein said peracid salt or peracid salts are present in an amount exceeding stoichiometric proportions with respect to said peracid precursor or precursors;

(b) about 0.002 to about 1.2% by weight of said iodide ion donor; and (c) an effective amount of catalase as a bleach scavenger for said peracid salt.

5. A washing composition for washing fabrics, comprising:

(i) about 0.5 to about 25 percent by weight of a peracid compound, selected from the group consisting of organic peracids, peracid salts, and organic peracid precursors which generate peracids by hydrolysis or perhydrolysis;

(ii) about 0.002 to about 1.2 percent by weight of an iodide ion donor which is effective in aqueous media;

(iii) about 5 to about 50 percent by weight of a surfactant selected from the group consisting of anionic, nonionic, semi-polar, ampholytic and zwitterionic detergents, and (iv) about 5 to about 70 percent by weight of a detergency builder.

6. A washing composition according to claim 5, comprising about 1 to about 15 percent by weight of said peracid compound and about 0.2 to about 0.6 percent by weight of said iodide ion donor.

7. A washing composition according to claim 5, comprising 0.5–25% by weight of an organic peracid precursor which generates peracids on perhydrolysis and 0.5–50% by weight of a persalt.

8. A washing composition according to claim 7, comprising 1–15% by weight of said organic peracid precursor and 0.5–30% by weight of said persalt.

9. A washing composition according to claim 7, wherein said organic peracid precursor is N,N,N′,N′-tetra-acetylethylene diamine.

10. A washing composition according to claim 7, wherein said peracid salt is selected from the group consisting of sodium perborate and sodium percarbonate.

11. A washing composition according to claim 7, wherein said precursor is present in at least stoichiometric ratio to the persalt.

12. A process for the aqueous medium washing of fabrics utilizing an effective amount of the washing composition of claim 1 at a temperature in the range of about 60° C. to about room temperature.

13. The process of claim 12 wherein said aqueous medium washing process is carried out at a temperature in the range of about 40° C. to about room temperature.

* * * * *